US009056391B1

(12) United States Patent
Wu

(10) Patent No.: US 9,056,391 B1
(45) Date of Patent: Jun. 16, 2015

(54) WRENCH WITH A LOCKABLE TORQUE-SETTING MECHANISM

(71) Applicant: Matatakitoyo Tool Co., Ltd., Taichung (TW)

(72) Inventor: Yi-Min Wu, Taichung (TW)

(73) Assignee: MATATAKITOYO TOOL CO., LTD., Taichung (TW)

( * ) Notice: Subject to any disclaimer, the term of this patent is extended or adjusted under 35 U.S.C. 154(b) by 0 days.

(21) Appl. No.: 14/485,397

(22) Filed: Sep. 12, 2014

(51) Int. Cl.

| | |
|---|---|
| ***B25G 1/01*** | (2006.01) |
| ***B25B 23/142*** | (2006.01) |
| ***G05G 1/04*** | (2006.01) |
| ***G05G 5/00*** | (2006.01) |
| ***B25B 23/14*** | (2006.01) |
| ***B25G 1/10*** | (2006.01) |
| *B25G 1/00* | (2006.01) |

(52) U.S. Cl.
CPC ..... *B25B 23/1427* (2013.01); *G05G 1/04* (2013.01); *G05G 5/005* (2013.01); *B25B 23/141* (2013.01); *B25G 1/00* (2013.01); *B25G 1/105* (2013.01); *B25G 1/10* (2013.01); *B25B 23/14* (2013.01)

(58) Field of Classification Search
CPC .. B25B 23/1427; B25B 23/141; B25B 23/14; B25G 1/105; B25G 1/00; B25G 1/10
USPC ..... 81/467, 489
See application file for complete search history.

(56) References Cited

U.S. PATENT DOCUMENTS

| | | | | |
|---|---|---|---|---|
| 4,466,523 | A * | 8/1984 | De Carolis et al. | 192/43.1 |
| 4,696,208 | A * | 9/1987 | Lay | 81/58 |
| 5,379,873 | A * | 1/1995 | Shiao | 192/43 |
| 5,437,212 | A * | 8/1995 | Thompson et al. | 81/63.1 |
| 5,749,272 | A * | 5/1998 | Phan | 81/62 |
| 6,393,949 | B1 * | 5/2002 | Ho | 81/62 |
| 6,463,834 | B2 * | 10/2002 | Kemp et al. | 81/483 |
| 7,430,945 | B2 * | 10/2008 | Gauthier et al. | 81/467 |
| 7,647,852 | B1 * | 1/2010 | Rinner | 81/62 |
| 2007/0289391 | A1 * | 12/2007 | Gao | 73/862.21 |

* cited by examiner

*Primary Examiner* — Monica Carter
*Assistant Examiner* — Danny Hong

(57) ABSTRACT

A locking mechanism includes a sleeve, a body, a pawl and a lever. The sleeve is non-movably connected to a grip and formed with teeth. The body is non-movably connected to a knob, partially inserted in the sleeve, and includes a recess in communication with a cavity. The pawl is movably inserted in the recess and formed with teeth. The lever includes an end for pressing the pawl and another end pivotally connected to the body. The lever is movable in the cavity of the body between a first position to press a first portion of the pawl to engage the teeth of the pawl with the teeth of the sleeve and a second position to press a second portion of the pawl to disengage the teeth of the pawl from the teeth of the sleeve.

20 Claims, 16 Drawing Sheets

WRENCH WITH A LOCKABLE TORQUE-SETTING MECHANISM

BACKGROUND OF INVENTION

1. Field of Invention

The present invention relates to a wrench equipped with a torque-setting mechanism and, more particularly, to a wrench equipped with a lockable torque-setting mechanism.

2. Related Prior Art

Wrenches are used to exert torque on fasteners such as threaded bolts and nuts to fasten work-pieces. It is important to exert a proper value of torque. In some applications, it is particularly important to have the value of torque close to but under a limit to effectively fasten the work-pieces without the risks of damaging the work-pieces.

Some wrenches are equipped with torque-setting mechanisms. Such a torque-setting mechanism is used to set a maximum value of torque that can be exerted via such a wrench. A typical torque-setting mechanism includes a knob connected to a handle of a wrench. The maximum value of torque is set by rotating the knob relative to the handle. The knob might however be accidentally rotated relative to the handle in operation.

In another conventional torque-setting mechanism, the knob is formed with teeth for engagement with teeth formed on the handle. The knob can be translated relative to the handle between two positions. In the first position, the teeth of the knob are engaged with the teeth of the handle so that the knob cannot be rotated relative to the handle. In the second position, the teeth of the knob are disengaged from the teeth of the handle so that the knob can be rotated relative to the handle. The knob might however be excessively translated and hence removed from the handle.

In another conventional torque-setting mechanism, a spring-biased detent is connected to the knob and a recess is made in the handle. The spring-biased detent is intended for insertion in the recess to keep the knob connected to the handle. The insertion of the spring-biased detent in the recess has however been proven to be ineffective to keep the knob connected to the handle.

In another conventional torque-setting mechanism as disclosed in Taiwanese Patent M371616 issued to the present applicant, the handle is made with an adequate length to keep the knob connected to the handle should the spring-biased detent be removed out of the recess again. The long handle is however unreliable.

Therefore, the present invention is intended to obviate or at least alleviate the problems encountered in prior art.

SUMMARY OF INVENTION

It is the primary objective of the present invention to provide a wrench with a reliable lockable torque-setting mechanism.

To achieve the foregoing objective, the lockable torque-setting mechanism includes a locking mechanism. The locking mechanism includes a sleeve, a body, a pawl and a lever The sleeve is non-movably connected to a grip of the wrench and formed with teeth. The body is non-movably connected to a knob, partially inserted in the sleeve, and includes a recess in communication with a cavity. The pawl is movably inserted in the recess and formed with teeth. The lever includes an end for pressing the pawl and another end pivotally connected to the body. The lever is movable in the cavity of the body between a first position to press a first portion of the pawl to engage the teeth of the pawl with the teeth of the sleeve and a second position to press a second portion of the pawl to disengage the teeth of the pawl from the teeth of the sleeve.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
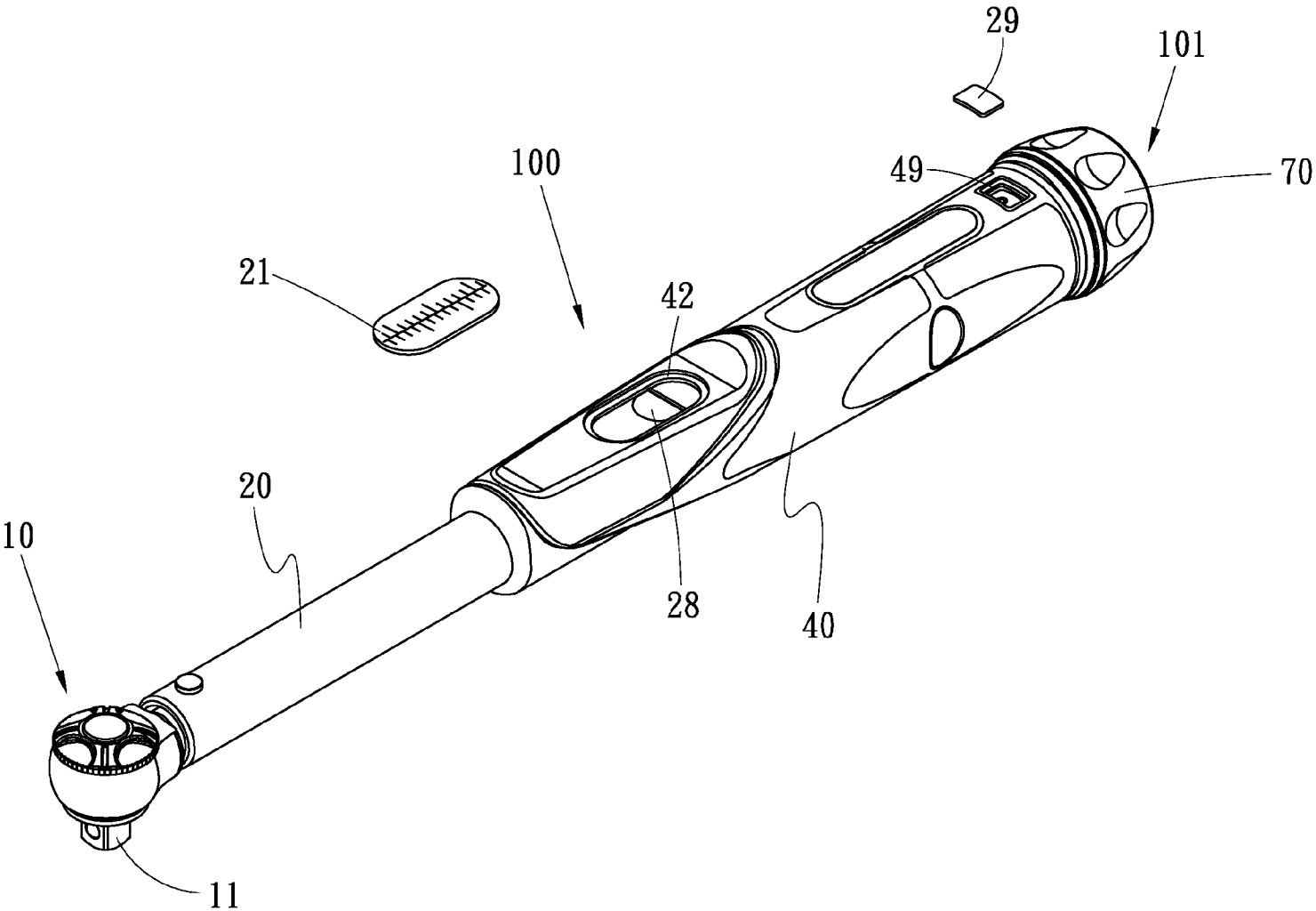
FIG. 1 is a perspective view of a wrench equipped with a lockable torque-setting mechanism according to the first embodiment of the present invention.
Figure 2:
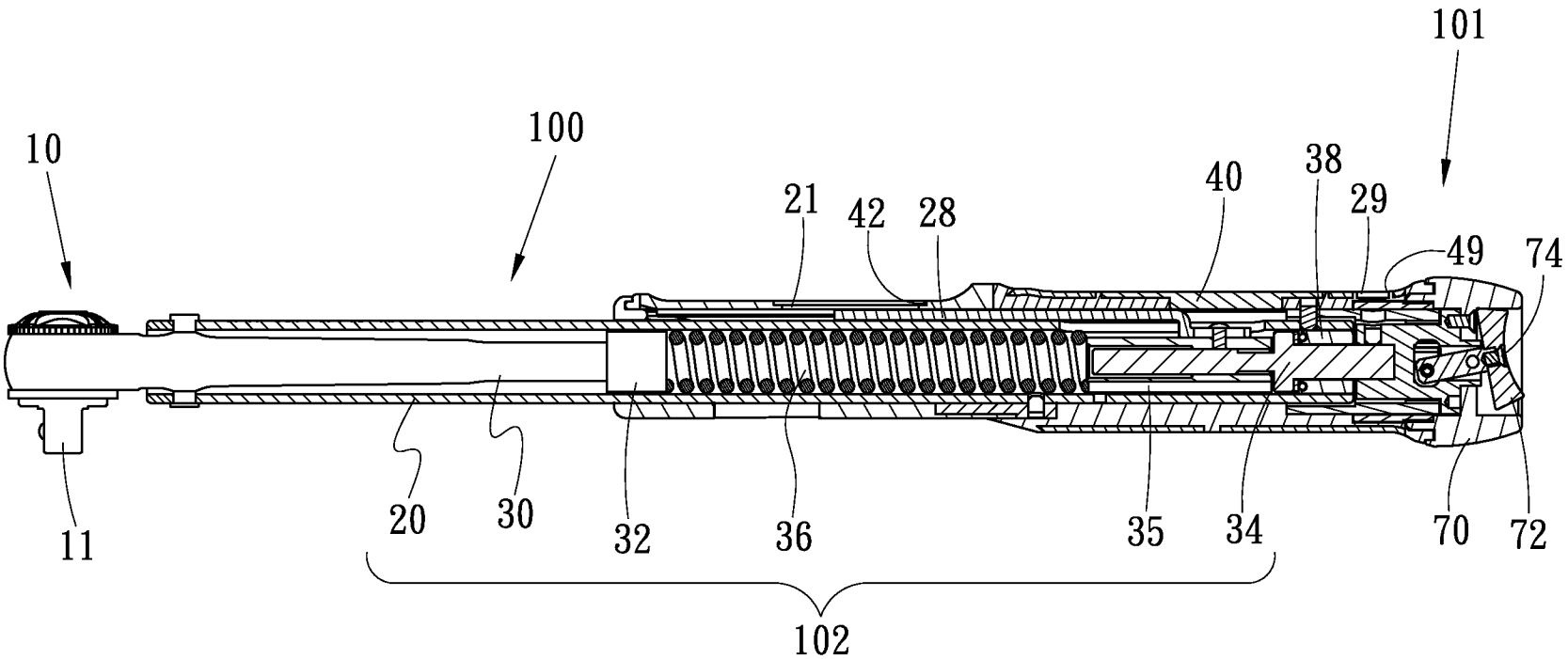
FIG. 2 is a cross-sectional view of the wrench shown in FIG. 1.

Referring to FIGS. 1 through 13, there is a wrench 100 according to a first embodiment of the present invention. The wrench 100 includes a head 10, a grip 40, a torque-relaying mechanism 102 for delivering torque to the head 10 from the grip 40, a torque-setting mechanism 101 operable for setting a maximum value of torque deliverable via the torque-relaying mechanism 102, and a locking mechanism (not numbered) operable for locking the torque-setting mechanism 101. The head 10 is operatively connected to an insert 11 via a ratchet mechanism that is not shown for being conventional.

The grip 40 is a tubular element with two windows 42 and 49 made in the periphery. A lens 21 is attached to the grip 40 to cover the window 42. The lens 21 is made or printed with a scale. The scale includes two unit systems such as lb-ft and N-m. A lens 29 is attached to the grip 40 to cover the window 49.

The torque-setting mechanism 101 includes a threaded rod 34, a threaded sleeve 35, a bearing 38, a knob 70 and an indicator 28. The threaded rod 34 is connected to the knob 70. The threaded rod 34 can be rotated but cannot be translated in the grip 40. The threaded sleeve 35 can be translated but cannot be rotated in the grip 40. The threaded sleeve 35 is engaged with the threaded rod 34. Thus, the knob 70 is operable to rotate the threaded rod 34 to translate the threaded sleeve 35. The indicator 28 is connected to the threaded sleeve 35 so that they can be translated together. The indicator 28 is observable via the lens 21. The position of the indicator 28 relative to the scale made or printed on the lens 21 represents the maximum value of torque set by the torque-setting mechanism.

The torque-relaying mechanism 102 includes a shank 20, a lever 30, a rolling unit 32 and a spring 36. The spring 36 is compressed between the threaded sleeve 35 and the rolling unit 32. The rolling unit 32 is in detachable contact with an inclined face formed at an end of the lever 30. The lever 30 is pivotally inserted in the shank 20, which is connected to the grip 40. The head 10 is formed at another end of the lever 30.

The structures and operations of the torque-setting mechanism 101 and the torque-relaying mechanism 102 will not be provided because they can be found in U.S. Pat. No. 7,182,006.

The locking mechanism includes a sleeve 44, a body 50, a lever 60, a spring 64, two caps 63, two pawls 65 and a switch 72. Each of the pawls 65 is formed with teeth 66.

Figure 5:
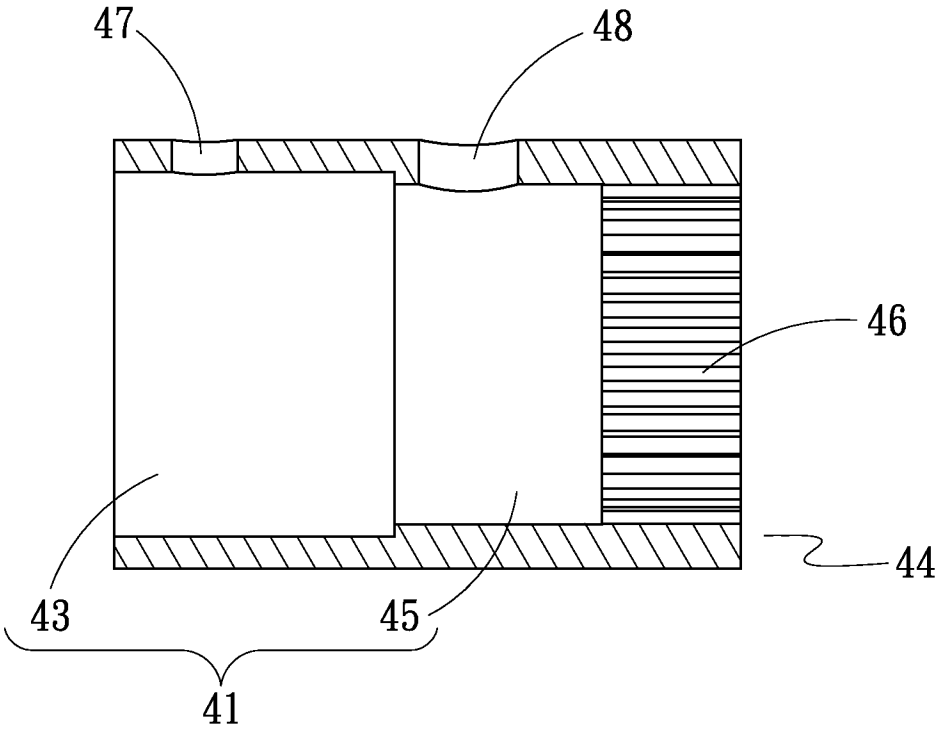
FIG. 5 is an enlarged view of a sleeve used in the wrench shown in FIG. 2.

Referring to FIG. 5, the sleeve 44 includes an axial space 41, two radial apertures 47 and 48 and teeth 46. The axial space 41 includes a large portion 43 and a small portion 45, with a shoulder formed between them. The large portion 43 of the axial space 41 is in communication with the radial aperture 47. The small portion 45 of the axial space 41 is in communication with the radial aperture 48. The teeth 46 are formed on an internal face of the sleeve 44, in the small portion 45 of the axial space 41.

Figure 6:
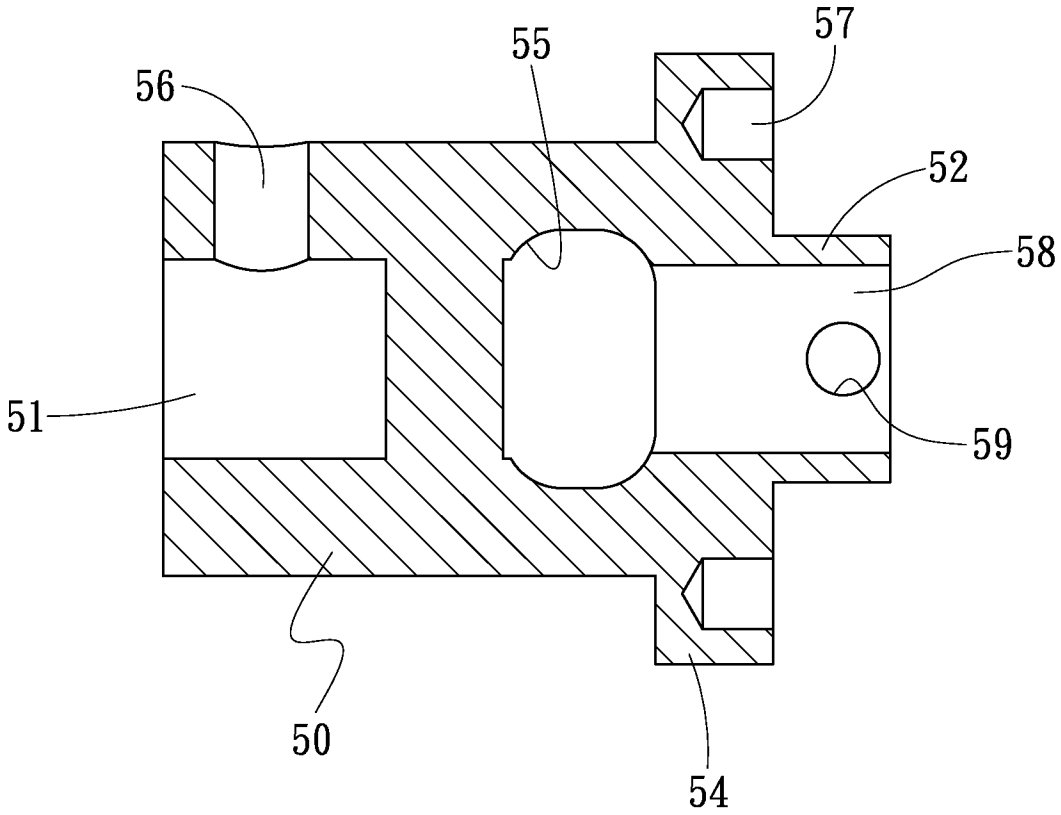
FIG. 6 is an enlarged view of a body used in the wrench shown in FIG. 2.
Figure 7:
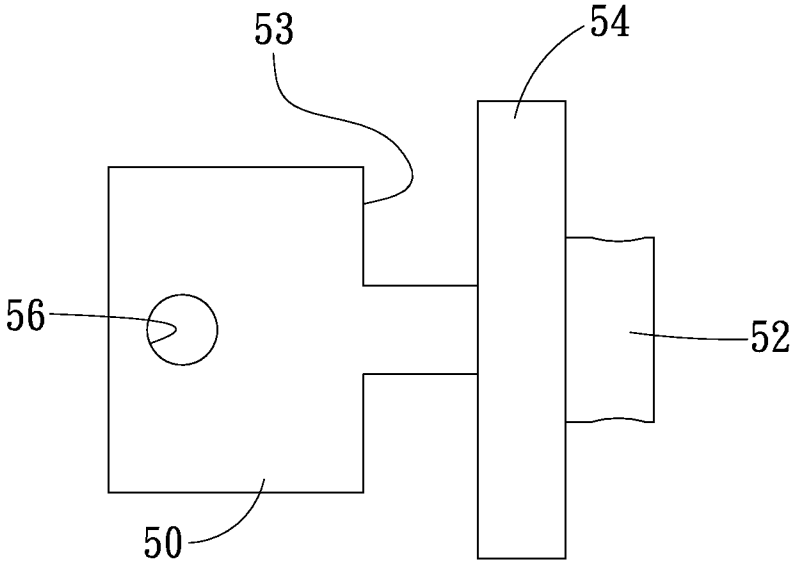
FIG. 7 is a side view of the body shown in FIG. 6.

Referring to FIGS. 6 and 7, the body 50 includes two axial cavities 51 and 58, a neck 52 formed at an end, an annular flange 54 formed near the neck 52, and two recesses 53 made near the annular flange 54. The axial cavity 58 is made in the neck 52. The recesses 53 are in communication with the axial cavity 58 via a bore 55. The recess 53, the bore 55 and the axial cavity 58 together form a T-shaped channel. The body 50 further includes an axial aperture 56 in communication with the axial cavity 51. The body 50 includes two more radial apertures 59 in communication with the axial cavity 58. Two screw holes 57 are made in the annular flange 54.

Figure 8:
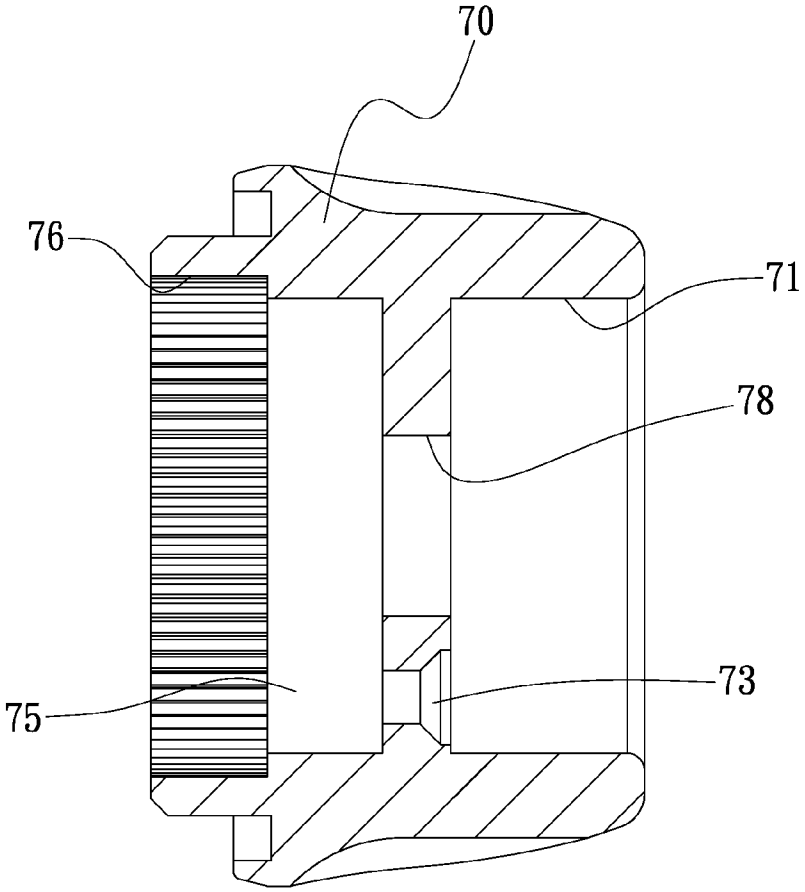
FIG. 8 is an enlarged view of a knob used in the wrench shown in FIG. 2.

Referring to FIG. 8, the knob 70 includes two axial cavities 71 and 75, an axial bore 78 via which the axial cavity 71 is in communication with the axial cavity 75, and a countersink hole 73. The knob 70 further includes teeth 76 formed on an internal face, in the axial cavity 75.

Figure 9:
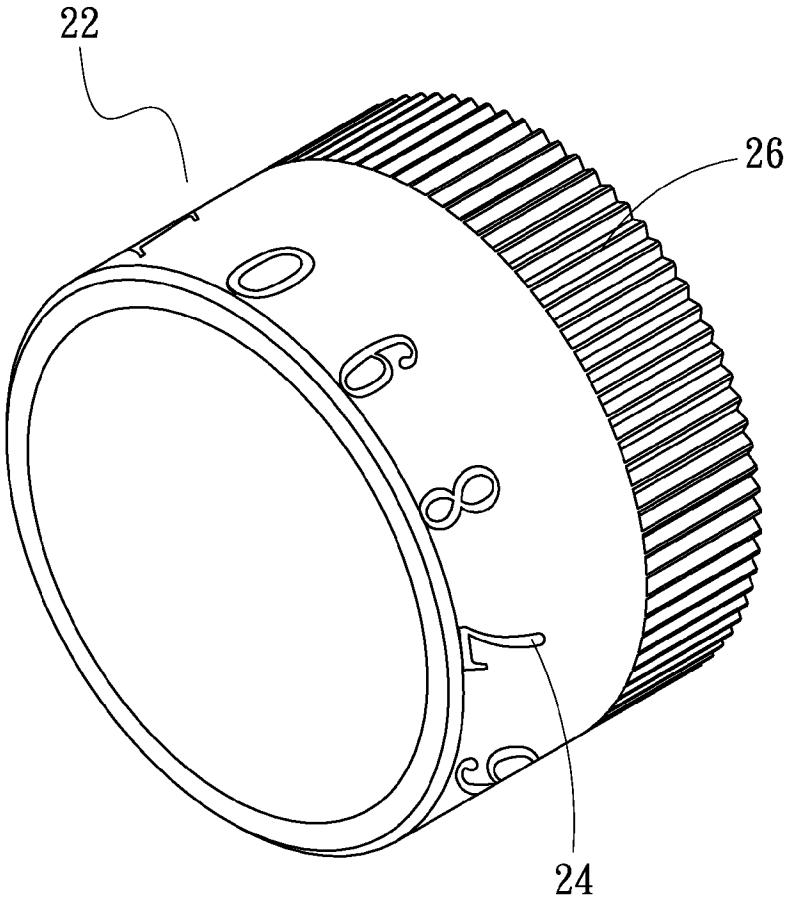
FIG. 9 is an enlarged perspective view of a scale ring used in the wrench shown in FIG. 2.

Referring to FIG. 9, a scale ring 22 includes a scale 24 formed or printed with on an external face and teeth 26 formed on the external face. The scale 24 includes smaller units than the scale formed or printed on the lens 21.

Figure 3:
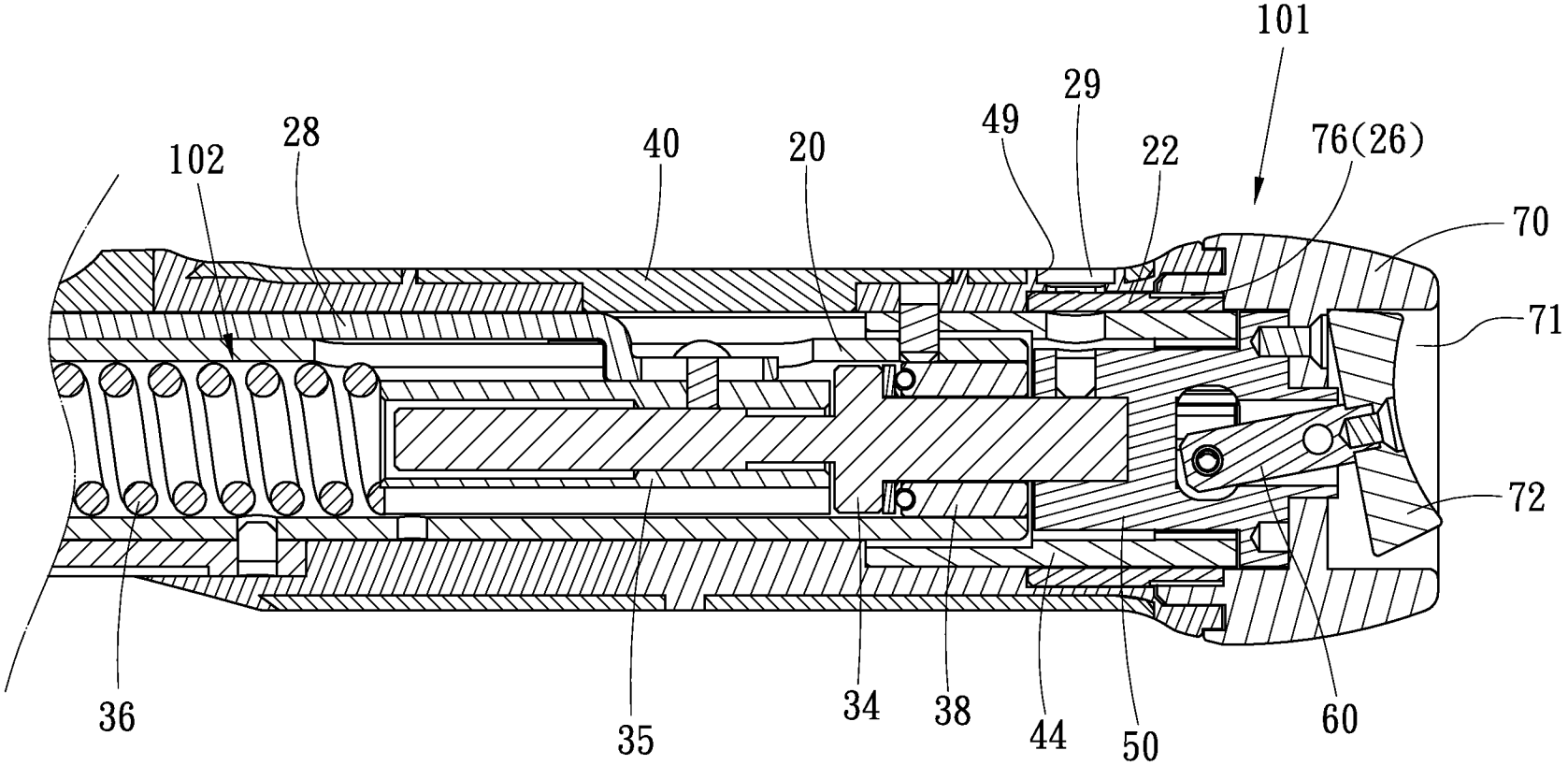
FIG. 3 is an enlarged partial view of the wrench shown in FIG. 2.
Figure 4:
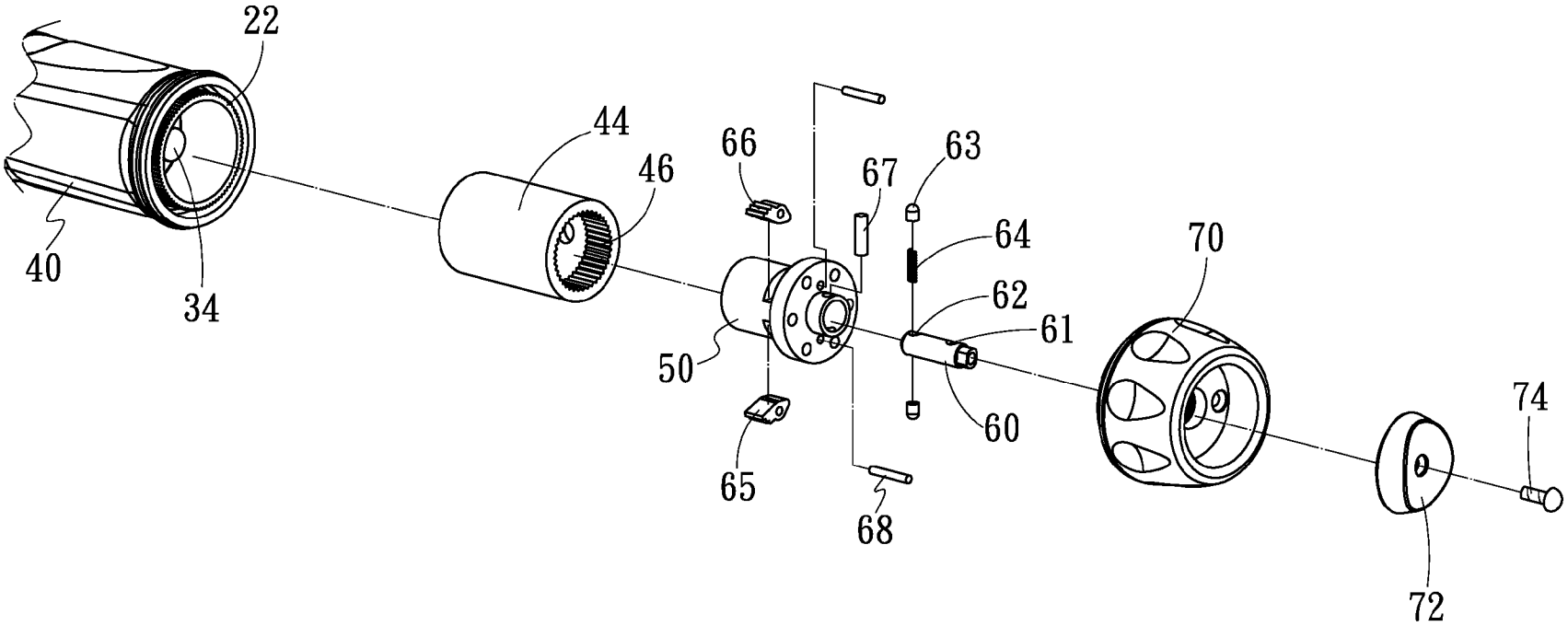
FIG. 4 is an exploded view of the wrench shown in FIG. 3.

Referring to FIGS. 3 and 4, the sleeve 44 is secured to the shank 20 via a screw (not numbered). The scale ring 22 is placed on the sleeve 44. The pawls 65 are placed in the recesses 53 and pivotally connected to the annular flange 54 by two pins 68. The body 50, except the annular flange 54 and the neck 52, is inserted in the sleeve 44. The teeth 66 of the pawls 65 can be engaged with the teeth 46 of the sleeve 44.

The spring 64 includes a middle portion inserted in an aperture 62 made in the lever 60 and two ends inserted in the caps 63. The lever 60 includes a portion inserted in the axial cavity 58 and the bore 55 of the body 50. A pin 67 is inserted in the radial apertures 59 of the neck 52 and an aperture 61 made in the lever 60 to pivotally connect the lever 60 to the body 50. The caps 63 are in contact with the pawls 65. The lever 60 includes another portion inserted in axial bore 78 of the knob 70. A screw 74 is inserted in the lever 60 via an axial aperture (not numbered) made in the switch 72 to connect the switch 72 to the lever 60. A screw (not shown) is inserted in the countersink hole 73 of the knob 70 and one of the screw holes 57 of the body 50 to connect the knob 70 to the body 50 so that they are rotatable together.

Figure 10:
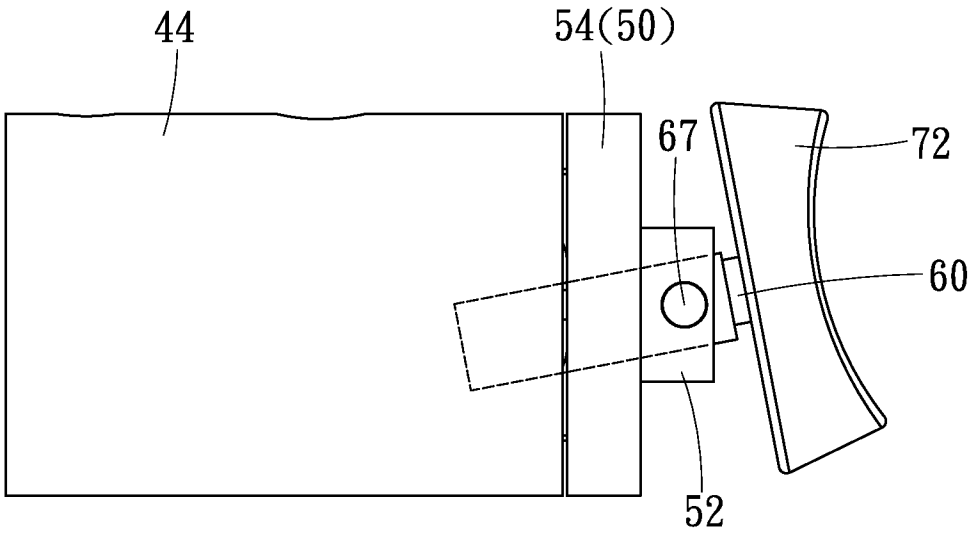
FIG. 10 is a side view of a combination of a switch with the sleeve shown in FIG. 5 and the body shown in FIGS. 6 and 7.
Figure 11:
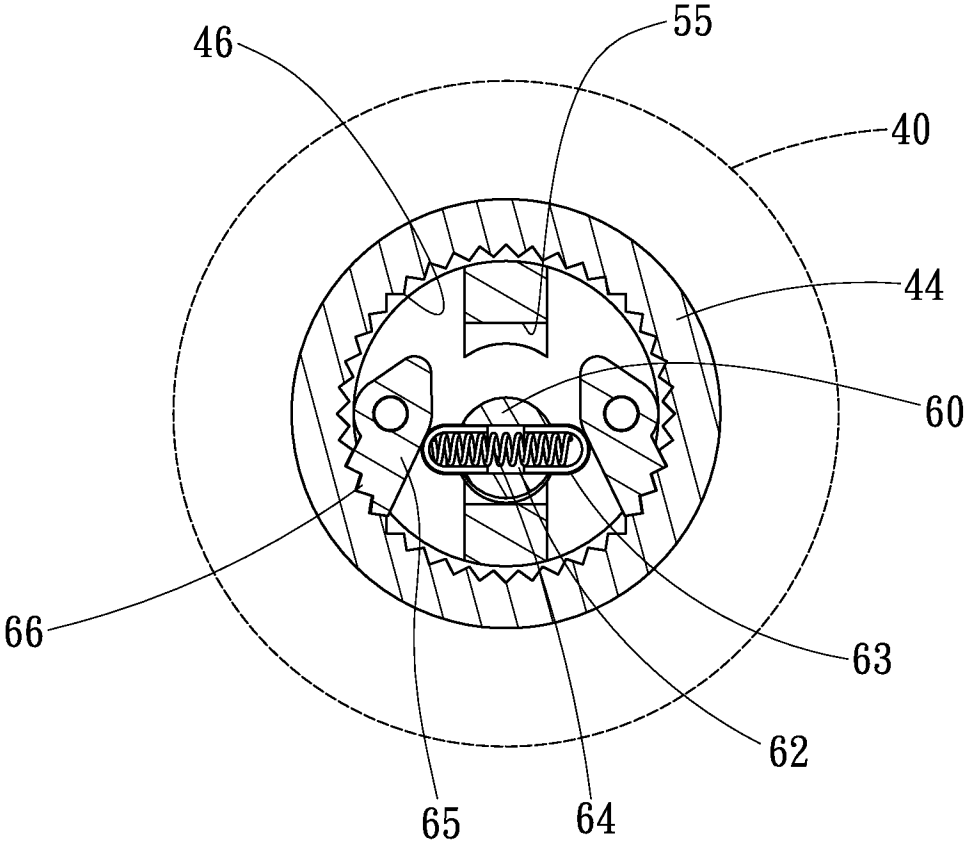
FIG. 11 is a cross-sectional view of the combination illustrated in FIG. 10.

Referring to FIGS. 10 and 11, the switch 72 is pivoted into a first position like a seesaw. Thus, the lever 60 is pivoted into a first position. Each of the caps 63 is abutted against a first portion of a corresponding one of the pawls 65 so that the teeth 66 of the pawls 65 are engaged with the teeth 46 of the sleeve 44. The body 50 cannot be rotated relative to the sleeve 44. Therefore, the knob 70 cannot be rotated relative to the shank 20.

Figure 12:
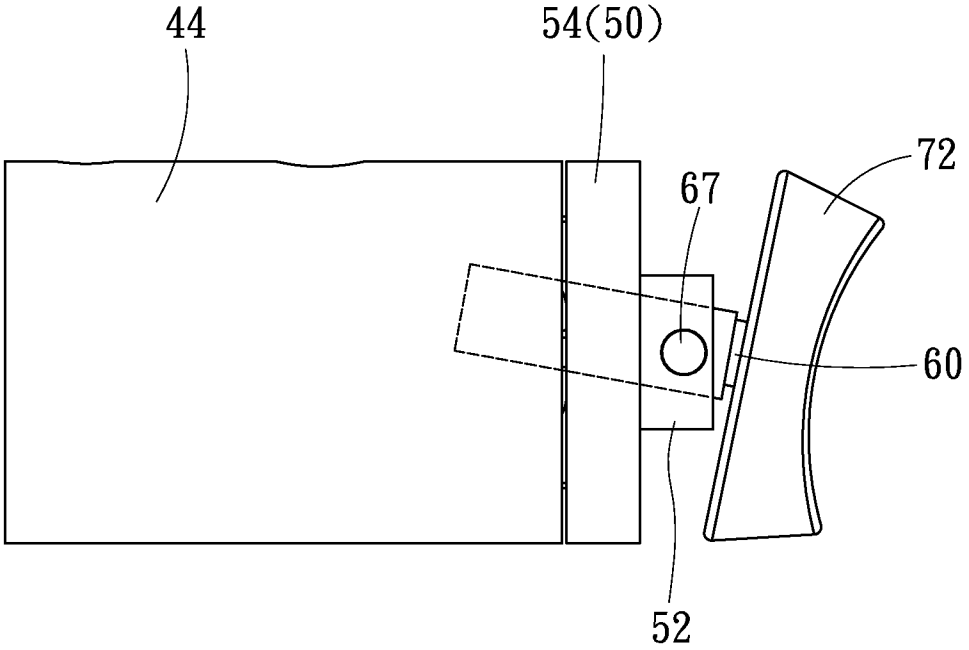
FIG. 12 is a side view of the combination in another position than shown in FIG. 10.
Figure 13:
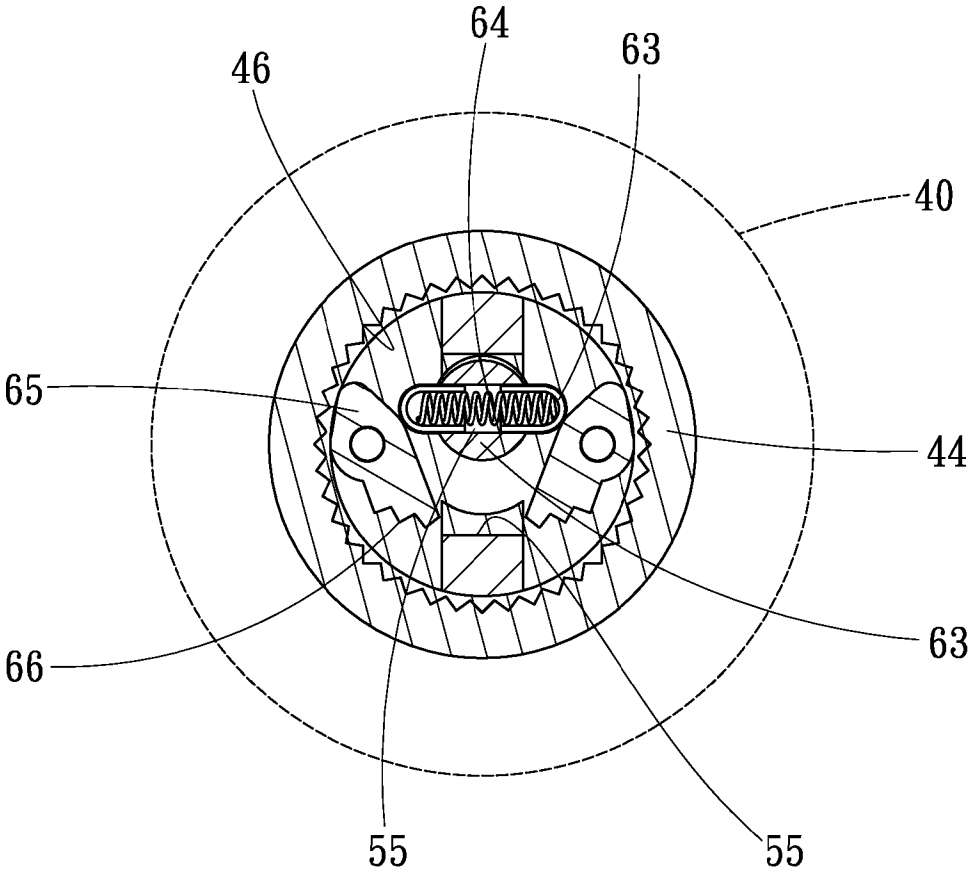
FIG. 13 is a cross-sectional view of the combination illustrated in FIG. 12.

Referring to FIGS. 12 and 13, the switch 72 is switched into a second position. The lever 60 is pivoted into a second position. Each of the caps 63 is abutted against a second portion of a corresponding one of the pawls 65 so that the teeth 66 of the pawls 65 are disengaged from the teeth 46 of the sleeve 44. The body 50 can be rotated relative to the sleeve 44. Hence, the knob 70 can be rotated relative to the shank 20.

Figure 14:
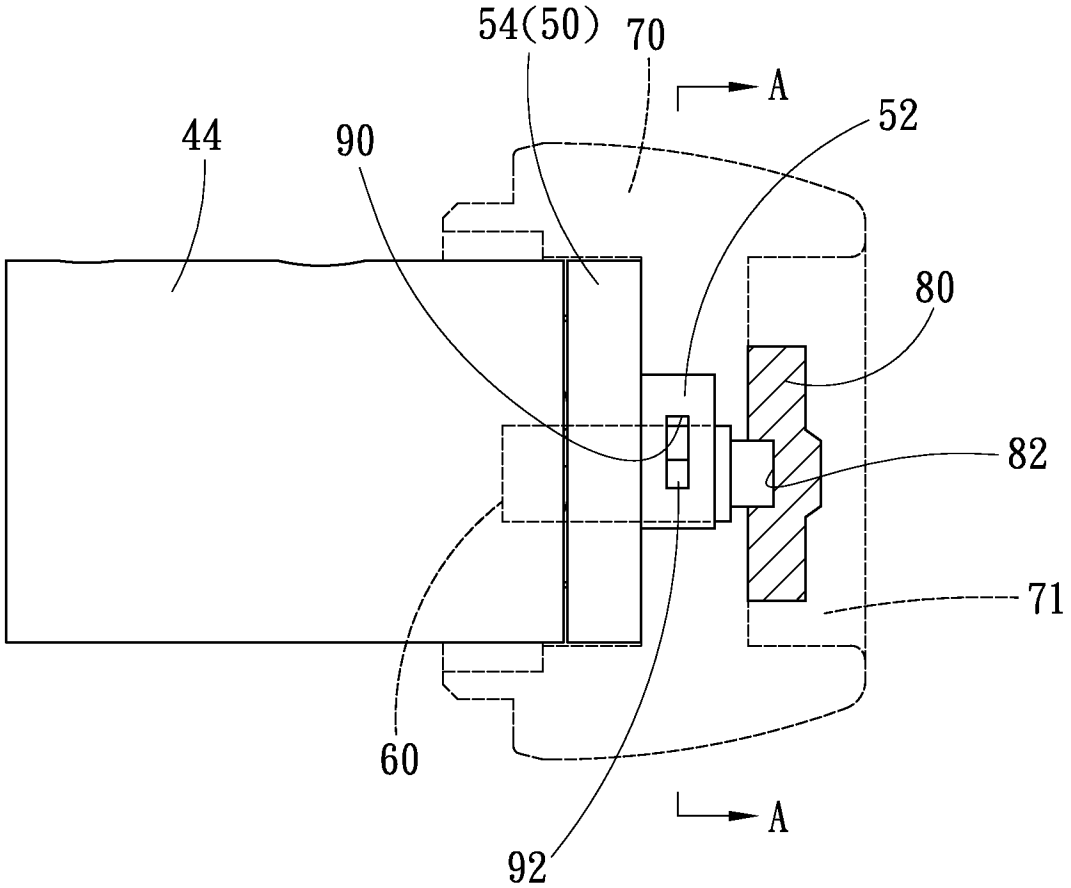
FIG. 14 is a cross-sectional view of a lockable torque-setting mechanism according to the second embodiment of the present invention.
Figure 15:
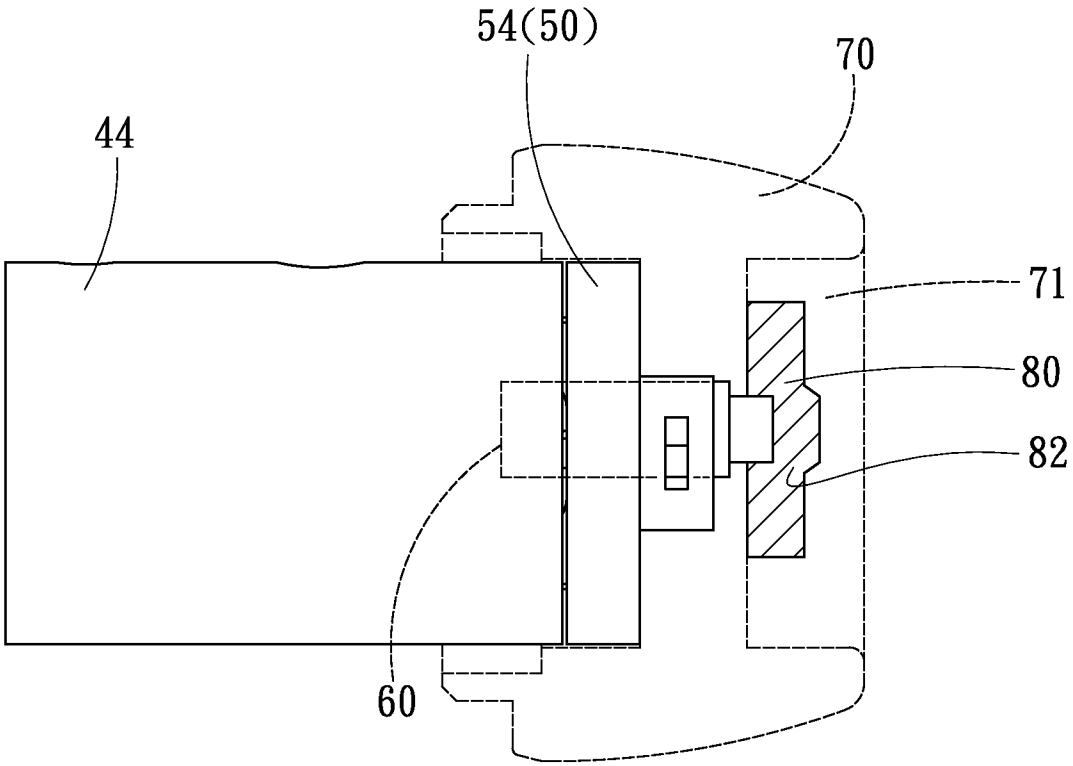
FIG. 15 is a cross-sectional view of the lockable torque-setting mechanism in another position than shown in FIG. 14.
Figure 16:
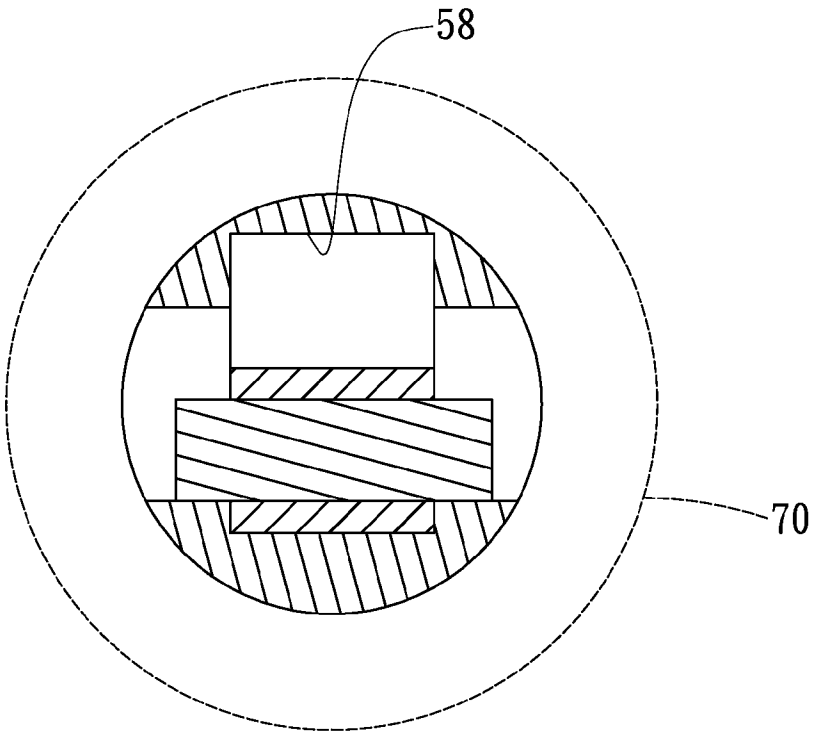
FIG. 16 is another cross-sectional view of the lockable torque-setting mechanism shown in FIG. 15.

Referring to FIGS. 14 to 16, there is a locking mechanism operable for locking a torque-setting mechanism of a wrench according to a second embodiment of the present invention. The second embodiment is like the first embodiment except several features. Firstly, a switch 80 that can be translated relative to the grip 40 is used instead of the switch 72 that can be pivoted relative to the grip 40. The switch 80 includes a bore 82 for receiving an end of the lever 60. Secondly, the lever 60 can be translated, instead of pivoted, relative to the body 50. Accordingly, the axial cavity 58 is a groove adapted for movably receiving an end of the lever 60. Moreover, the neck 52 is made with two slots 90 for movably receiving two bosses 92 formed on the lever 60.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A locking mechanism for locking a knob relative to a grip, the locking mechanism including:

a sleeve non-movably connected to the grip and formed with teeth;

a body non-movably connected to the knob, partially inserted in the sleeve, and formed with at least one recess and a cavity in communication with the recess;

at least one pawl movably inserted in the recess and formed with teeth; and a lever formed with an end for abutment against the pawl and movable in the cavity of the body between a first position to press a first portion of the pawl to engage the teeth of the pawl with the teeth of the sleeve and a second position to press a second portion of the pawl to disengage the teeth of the pawl from the teeth of the sleeve.

2. The lockable torque-setting mechanism according to claim 1, wherein the lever is pivotally connected to the body.

3. The lockable torque-setting mechanism according to claim 2, further including a pin inserted in the lever and the body.

4. The lockable torque-setting mechanism according to claim 1, wherein the lever is rectilinearly movable in the cavity of the body.

5. The lockable torque-setting mechanism according to claim 4, wherein the cavity of the body is in the form of a groove.

6. The lockable torque-setting mechanism according to claim 1, further including a switch operable to move the lever between the first and second positions.

7. The lockable torque-setting mechanism according to claim 6, further including a screw for connecting the switch to the lever.

8. The lockable torque-setting mechanism according to claim 6, wherein the switch includes a bore for receiving the lever.

9. The lockable torque-setting mechanism according to claim 1, further including a spring including a first end connected to the lever and a second end for pressing the pawl.

10. The lockable torque-setting mechanism according to claim 9, further including a cap including a recess for receiving the second end of the spring and a dome for contact with the pawl.

11. A wrench including:

a head;

a grip;

a torque-relaying mechanism for delivering torque to the head from the grip;

a torque-setting mechanism operable for setting a maximum value of torque deliverable via the torque-relaying mechanism, wherein the torque-setting mechanism includes a knob; and a locking mechanism including:

a sleeve non-movably connected to the grip and formed with teeth;

a body non-movably connected to the knob, partially inserted in the sleeve, and formed with at least one recess and a cavity in communication with the recess;

at least one pawl movably inserted in the recess and formed with teeth; and a lever formed with an end for abutment against the pawl and movable in the cavity of the body between a first position to press a first portion of the pawl to engage the teeth of the pawl with the teeth of the sleeve and a second position to press a second portion of the pawl to disengage the teeth of the pawl from the teeth of the sleeve.

12. The wrench according to claim 1, wherein the lever is pivotally connected to the body.

13. The wrench according to claim 12, wherein the locking mechanism further includes a pin inserted in the lever and the body.

14. The wrench according to claim 11, wherein the lever is rectilinearly movable in the cavity of the body.

15. The wrench according to claim 14, wherein the cavity of the body is in the form of a groove.

16. The wrench according to claim 11, wherein the locking mechanism further includes a switch operable to move the lever between the first and second positions.

17. The wrench according to claim 16, wherein the locking mechanism further includes a screw for connecting the switch to the lever.

18. The wrench according to claim 16, wherein the switch includes a bore for receiving the lever.

19. The wrench according to claim 11, wherein the locking mechanism further includes a spring including a first end connected to the lever and a second end for pressing the pawl.

20. The wrench according to claim 19, wherein the locking mechanism further includes a cap including a recess for receiving the second end of the spring and a dome for contact with the pawl.

* * * * *